US007770349B2

(12) United States Patent
Tedesco et al.

(10) Patent No.: US 7,770,349 B2
(45) Date of Patent: Aug. 10, 2010

(54) SEISMIC CLIP FOR GRID TEE CONTROL JOINT

(75) Inventors: Lee M. Tedesco, Shorewood, IL (US); Paul D. LaLonde, Avon, OH (US); Ilya Lerner, Wheeling, IL (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 12/172,280

(22) Filed: Jul. 14, 2008

(65) Prior Publication Data

US 2010/0005747 A1 Jan. 14, 2010

(51) Int. Cl.
*E04B 9/00* (2006.01)

(52) U.S. Cl. ..... 52/506.08; 52/664; 52/506.06; 52/506.07

(58) Field of Classification Search ..... 52/506.06, 52/506.07, 506.08, 657
See application file for complete search history.

(56) References Cited

U.S. PATENT DOCUMENTS 2,703,159 A * 3/1955 Fleet ..... 52/656.5
3,089,570 A * 5/1963 O'Neil, Jr. ..... 52/713
3,102,306 A * 9/1963 Hutchinson ..... 29/897.3
3,677,589 A * 7/1972 Roles ..... 403/217
3,785,110 A * 1/1974 Galloway et al. ..... 52/715
3,835,614 A * 9/1974 Downing, Jr. ..... 52/666
4,019,300 A * 4/1977 Sauer et al. ..... 52/665
4,479,341 A * 10/1984 Schuplin ..... 52/665
4,485,605 A * 12/1984 LaLonde ..... 52/665
4,535,580 A * 8/1985 Shirey ..... 52/506.06
4,570,391 A * 2/1986 Quante et al. ..... 52/39
4,583,340 A * 4/1986 Sauer ..... 52/506.07
4,715,161 A * 12/1987 Carraro et al. ..... 52/714
5,046,294 A * 9/1991 Platt ..... 52/506.06
5,176,348 A * 1/1993 Gale ..... 248/220.22
5,279,090 A * 1/1994 Yamaguchi et al. ..... 52/506.08
5,349,800 A * 9/1994 Peng ..... 52/506.06
5,469,681 A * 11/1995 Wu ..... 52/656.9

(Continued)

OTHER PUBLICATIONS

USG Interiors, Inc., Drawing No. A1.1201.48, "Tee Intersection Bracket—4 Way", dated Nov. 1, 1993.

*Primary Examiner*—Richard E Chilcot, Jr.
*Assistant Examiner*—Alp Akbasli
(74) *Attorney, Agent, or Firm*—Pearne & Gordon LLP

(57) ABSTRACT

A clip for bridging a longitudinal gap between a pair of grid tee lengths, the clip having a cruciform shape in plan view formed by a set of four integral arms, one pair of the arms extending along a first line in opposite directions from a center of the clip, and another pair of arms extending along a line perpendicular to said first line in opposite directions from the center of the clip, said arms when oriented for installation having an inverted U-shape cross-section proportioned to fit over a respective one of four intersecting lengths of grid tees having an inverted T-shape with a reinforcing hollow bulb at its upper edge, at least one of said arms having a longitudinally extending fastener receiving slot and other of said arms having locations for receiving respective fasteners, said slot and receiving locations each being arranged to receive a fastener and allow the fastener to be anchored into the bulb of an associated tee, said slot being arranged to allow its respective grid tee length to telescope within the associated arm.

11 Claims, 4 Drawing Sheets

U.S. PATENT DOCUMENTS 5,937,605 A * 8/1999 Wendt ..... 52/506.06
5,941,029 A * 8/1999 MacLeod ..... 52/167.1
6,018,923 A * 2/2000 Wendt ..... 52/712
6,209,268 B1 * 4/2001 Schmidt ..... 52/92.1
2007/0180787 A1 * 8/2007 Fecska ..... 52/506.06
2008/0047213 A1 * 2/2008 Jaic ..... 52/506.06
2008/0060306 A1 3/2008 Platt et al.
2009/0223146 A1 9/2009 Platt

* cited by examiner

SEISMIC CLIP FOR GRID TEE CONTROL JOINT

BACKGROUND OF THE INVENTION

The invention relates to hardware for stabilizing a seismic control joint in a suspended ceiling grid.

PRIOR ART

Analysis of failures in suspended ceiling systems during seismic events has led to design criteria intended to reduce the risk of suspended ceiling collapse in mild or moderate earthquakes. One approach adopted in building codes applicable to expansive ceiling areas is the isolation of ceiling areas of a certain size from adjacent areas. This approach looks at large ceiling areas not divided by walls extending through the ceiling plane and divides such areas into limited sizes, for example, not greater than 2,500 square feet. At the boundaries of the subdivided areas, grid tees are provided with control joints. At these control joints, the lines of the grid tees crossing the joints are made discontinuous. There exists in the construction industry, a convenient, economical and effective way of isolating contiguous suspended ceiling areas from one another while establishing and maintaining proper alignment under normal static conditions.

SUMMARY OF THE INVENTION

The invention provides a clip for use in improving the resistance of suspended ceiling grid to failure when subjected to moderate seismic forces. The clip is used to bridge a gap or control joint created at the boundary between subdivided areas of a large ceiling grid area. The gap, which can be established between collinear lengths of main tees or lengths of cross tees, isolates the movement of one subdivided grid area from a contiguous area and thereby reduces the potential for failure of the grid. The inventive clip allows the gap between opposed tee elements to which it is attached to close-up when seismic forces are imposed on the grid and thereby dampen their destructive influence.

More specifically, a gap forming a control joint is in a line of a main tee run or a cross tee run and situated near or at main and cross tee intersections. The clip is arranged to be secured to all four tee sections making up the intersection where a gap is located.

In the disclosed embodiment, the clip is stamped from a single piece of sheet metal into a cruciform shape. Each of the four arms making the cruciform shape has an inverted U-shaped cross-section proportioned to fit over the reinforcing bulb of an associated one of the intersecting tee sections. Each of the arms has at least one hole for receiving a screw which is driven into the underlying reinforcing bulb. At least one of the clip arms has an elongated slot that, with the clip installed, extends along a reinforcing bulb. A screw or other fastener assembled in the slot and the bulb of the tee it overlies, holds the tee in its proper position. In the event of an earthquake, the retaining force of the screw is overcome, and the tee can move relative to the slot and the adjacent tees to close the gap, and thereby limit the forces on the ceiling grid and reduce the risk of it collapsing. The disclosed clip is easily and quickly installed, is economical to manufacture, and can be used in non-seismic applications to reinforce an intersection, thereby affording additional savings in tooling, manufacturing, shipping, and inventory.

DESCRIPTION OF THE PREFERRED EMBODIMENTS

Figure 6:
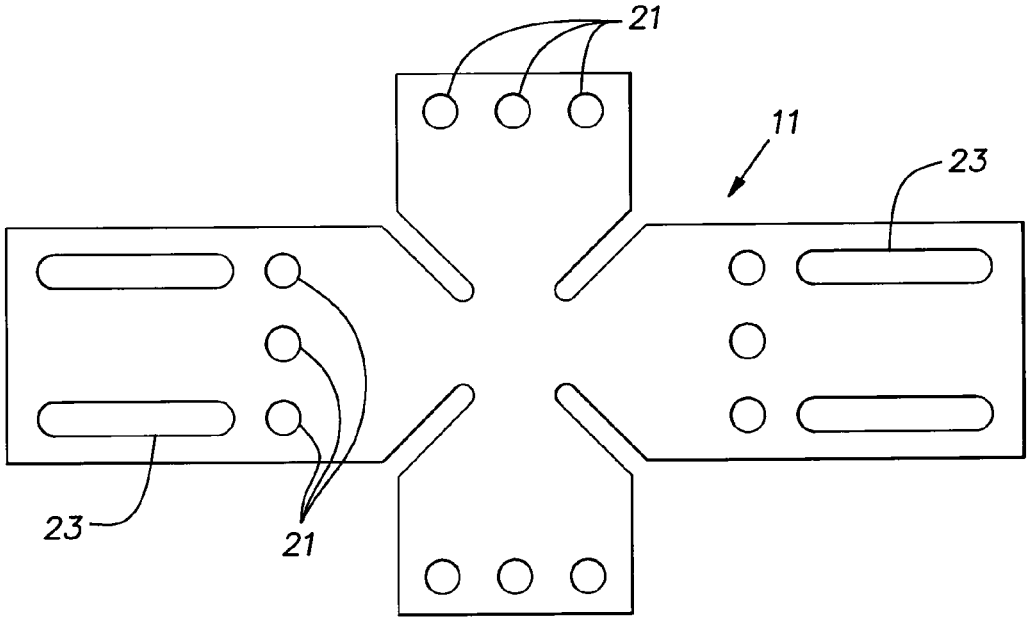
FIG. 6 is a plan view of a blank from which the clip is made.
Figure 7:
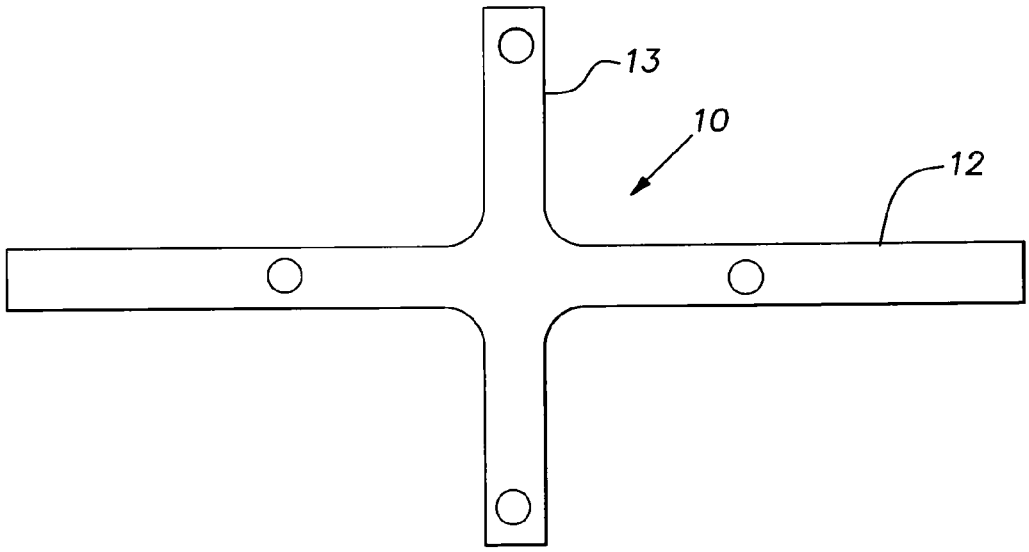
FIG. 7 is a plan view of the clip.
Figure 8:
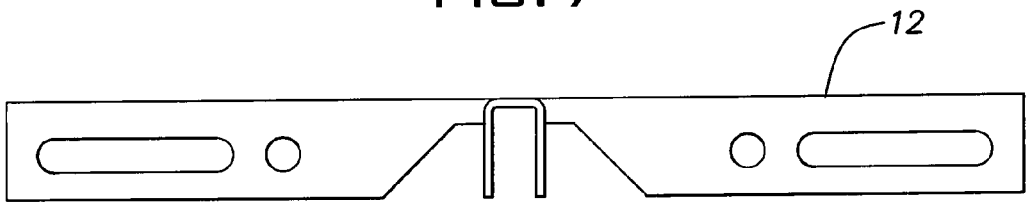
FIG. 8 is an elevational view of the clip.

A clip 10 having a cruciform shape in plan view is formed of sheet metal, which can be hot dipped, galvanized steel, for example. The clip 10 is initially stamped from metal sheet stock to form a blank 11 with the profile illustrated in FIG. 6. Thereafter, the blank 11 is stamped into the configuration illustrated in FIGS. 1-5, 7 and 8. The clip 10 includes four arms 12, 13, extending from a common center 14. As shown most clearly in FIG. 7, adjacent arms 13, 14 are at right angles and oppositely extending arms are colinear. In the installed orientation of the clip 10, the arms 12, 13, each have an inverted U-shaped cross-section. Opposed arms 12, 13 are identical and symmetrical with one another. One pair of opposed arms 12 are somewhat longer than the other pair of arms 13. Referring to the long arms 12, the arm cross-section is formed by an upper horizontal web 16 and depending flanges 17. Outer surfaces of the web 16 and flanges 17 form corresponding horizontal vertical faces of these arms 12. Similarly, the relatively shorter arms 13 each include a horizontal web 18 and vertically depending flanges 19, the web and flanges, respectively, representing the upper horizontal and side faces of the arms, respectively. Fastener locating zones in the form of holes 21 originally punched into the blank 11 preferably exist on the webs 16, 18, and flanges 17, 19, i.e. on all of the faces of the arms 12, 13, spaced from the center 14 of the clip.

The vertical flanges 17 of the longer arms 12 have elongated longitudinally extending slots 23 which can be conveniently formed in the original blank 11. As shown, the slots 23 on opposed flanges 17 of the same arm are vertically and longitudinally aligned with one another in the final configuration of the clip 10. Preferably, proximal flanges 17, 19, of adjacent arms 12, 13 are integrally joined at a respective juncture 20 which serves to stiffen and strengthen the clip.

The inside dimensions between the flanges 17, 19 of each of the arms 12, 13 provide a close fit on a standard grid tee bulb 26. By way of example, the horizontal dimension between the flanges 17 or 19 can be equal to the nominal bulb width of 0.250" up to about 0.005" over this dimension. Similar proportions are applicable to metric versions of grid tees. These dimensions enable each arm 12, 13 to fit, in the manner of a saddle, over the bulb 26 of a grid tee 27, 28. When the clip 10 is installed on an intersection of grid tees 27, 28, such as shown in FIGS. 2-5, the slots 23 and holes 21 overlie respective faces 31, 32 of the bulbs 26.

Figure 2:
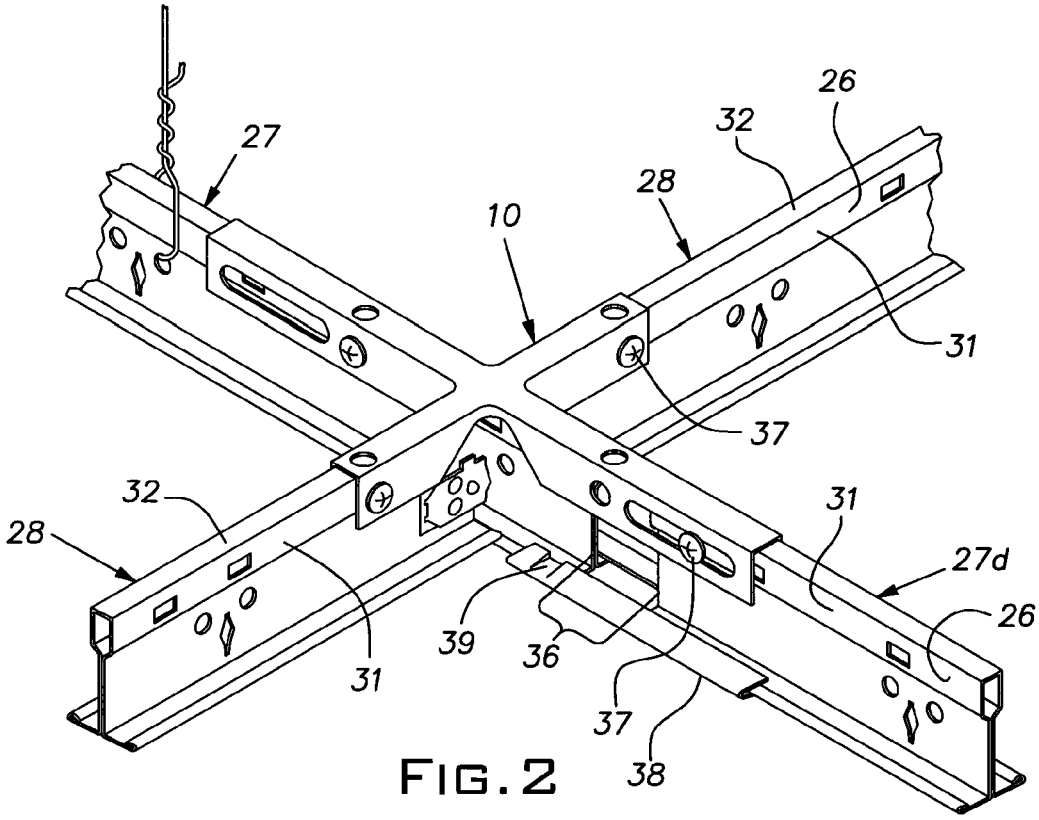
FIG. 2 is a perspective view of the clip where a control joint gap is formed on a main tee run adjacent a grid tee intersection.
Figure 3:
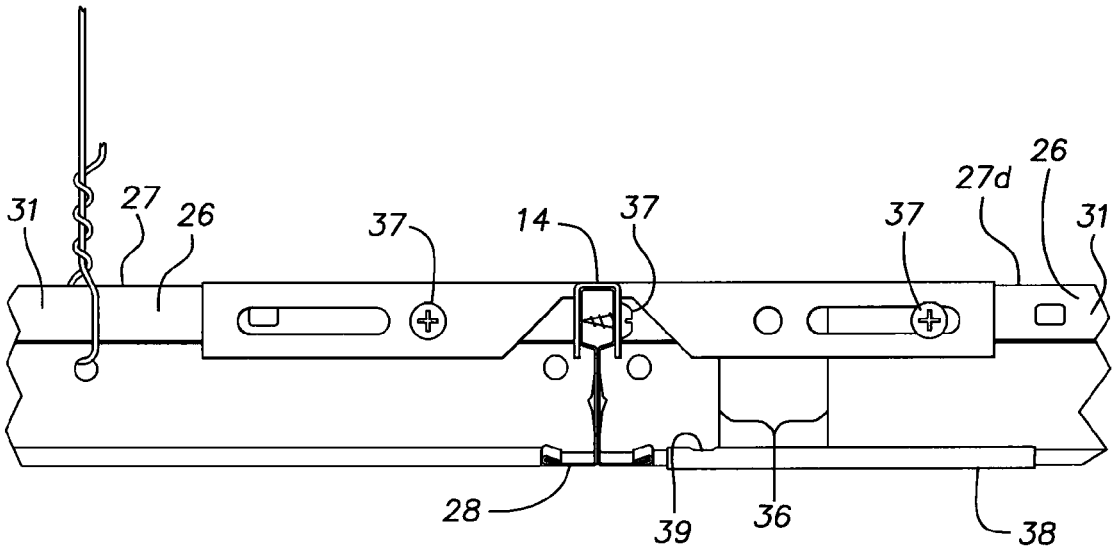
FIG. 3 is an elevational view of the clip and grid looking in a direction along a cross tee.

FIGS. 2 and 3 illustrate the clip 10 applied to a control joint or gap 36 made in a run of main tees 27. A main tee 27 in the run is cut in the field, i.e. at the site of installation, so that a complete gap 36 in the run is made. The gap is typically a minimum of 1", for example, in length, measured along the run. The gap 36 is created close to an intersection with cross tees 28 so that the end area of the bulb 26 of the main tee length remote from the intersection underlies a portion of the length of the adjacent slots 23 of the associated clip arm 12. Preferably, the slotted arm 12 is long enough to span a gap of 1" located about 1" beyond the center of the clip. The slots are preferably at least ¾" long, i.e. at least as long as three times the inside width of the channel formed by the web 16, 18 and flanges 17, 19 and more preferably at least about 1" long or metric equivalent. A fastener 37, typically a self-drilling screw, is assembled in a slot 23 adjacent the gap 36 and is driven into and anchored on the end portion of the tee reinforcing bulb 26 on the remote or far side of the gap 36. At least one fastener 37 is used to fix the clip 10 in position at the three remaining arms 12, 13 using one of the locating holes 21 for each such fastener. Having the slots 23 on both flanges of each long arm 12 and fastener locating holes on both the webs 16, 18, and flanges 17, 19 of the arms 12, 13 makes it convenient for the installer to reach at least one slot and/or one hole on each arm while he stands at a single location with respect to the grid intersection in question. Slots 23 on the two opposed long arms 12 facilitate installation of the clip 10 since it is properly positioned in either of two orientations.

Before installation of the clip 10 at a gap 36 in a main tee 27, a tee face sleeve 38, having a C-cross-section can be installed on the main tee flange ends to conceal the gap from view. Preferably, this sleeve 38 is formed with a crimp 39 at one of its ends on the main tee end near the intersection, so that the sleeve will not work its way out of position. The screw 37 positioned in the slot 23 and tightened into the bulb 26 of the distal main tee section 27*d* serves under normal conditions to hold the main tee grid lengths 27, 27*d* on opposite sides of the gap 36 in alignment laterally (horizontally), vertically, and longitudinally, under normal conditions. The gap 36 is repeated in successive parallel main tees along a line extending from this gap perpendicular to the main tee 27 to define a control joint.

Figure 4:
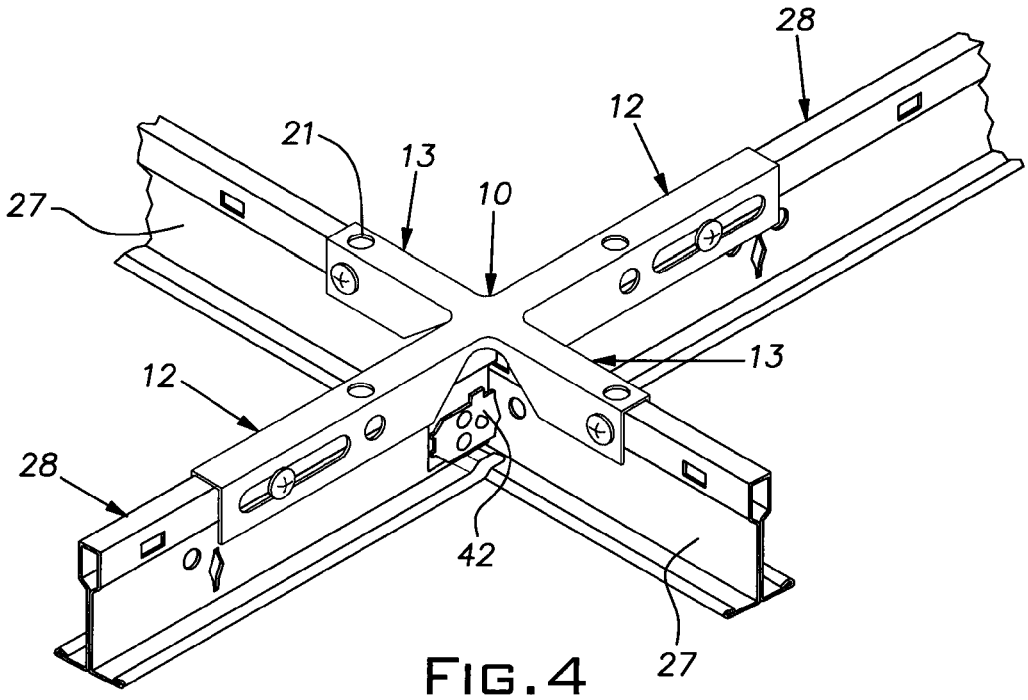
FIG. 4 is a perspective view of the clip where a control joint gap is formed on a cross tee run at a grid tee intersection.
Figure 5:
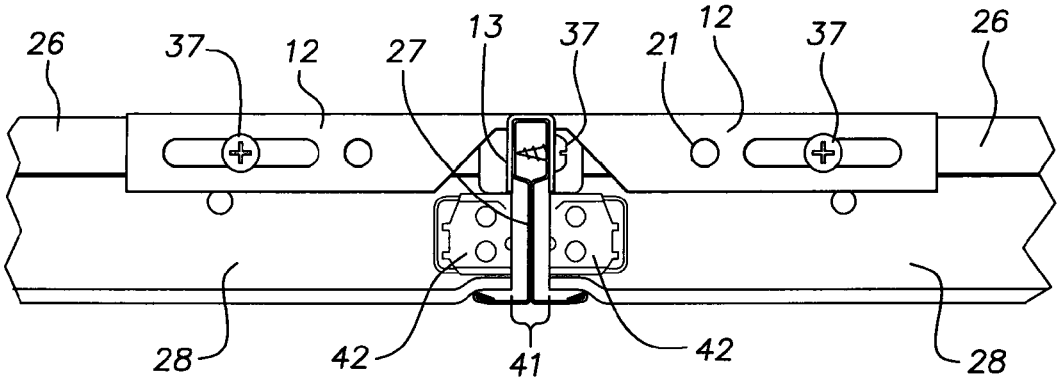
FIG. 5 is an elevational view of the clip and grid intersection looking in a direction along the main tee.

FIGS. 4 and 5 depict the clip 10 installed at an intersection of main and cross tees 27, 28 where a control joint is made by a gap 41 between a pair of longitudinally aligned cross tees. In this mode, in an expanse of grid, the control joint is made up of numerous such gaps 41 in other cross tee pairs extending along a common main tee run.

As will be seen most clearly in FIG. 5, ends of cross tee connectors 42, of any conventional construction, are cut off in the field by the installer of the grid. This severing of the original connector 42 leaves the gap 41 between the opposing end structure of the cross tees 28. The clip 10 is secured to the main tee 27 by screws or other fasteners 37 positioned in selected ones of the fastener holes 21. Similarly, the clip 10 is secured to the cross tees 28 by screws 37 assembled in flange slots 23 and underlying areas of the reinforcing bulbs 26 on both sides of the main tee 27. It will be seen that the center of the clip 10 bridges the gap 41. During normal service, it will be seen that the clip 10 holds the cross tees 28, modified by severing portions of their connectors 42 as described above, in proper alignment laterally, vertically, and longitudinally.

In a seismic event, a horizontal force or displacement perpendicular to a control joint can overcome the retaining force of the screws 37 in the arms slots 23 bridging the gap 36 or 41 of a control joint. This permits the grid area on one side of the control joint to move relative to the grid area on the other side of the joint or gap. This movement can reduce the forces imposed on the grid and thereby reduce the risk of its collapse. It will be seen that in both cases where the control joint gap exists in the main tee line or a cross tee line, the clip 10 is effective to maintain the parts of the tees to which it is fixed in alignment.

Figure 1:
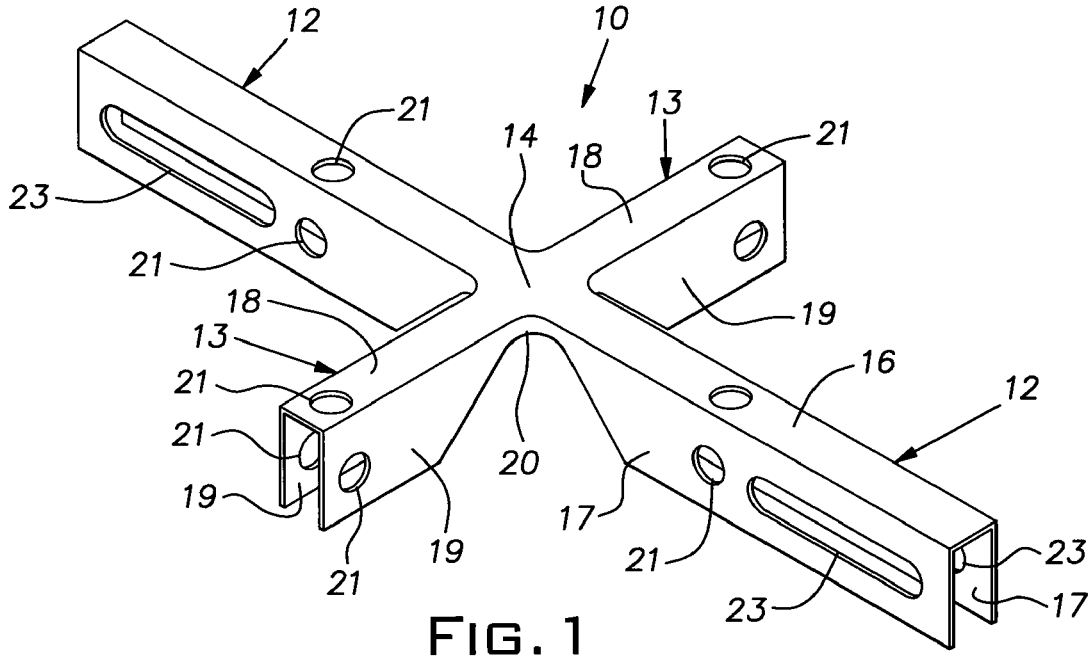
FIG. 1 is a perspective view of a first embodiment of the seismic clip of the invention.
Figure 9:
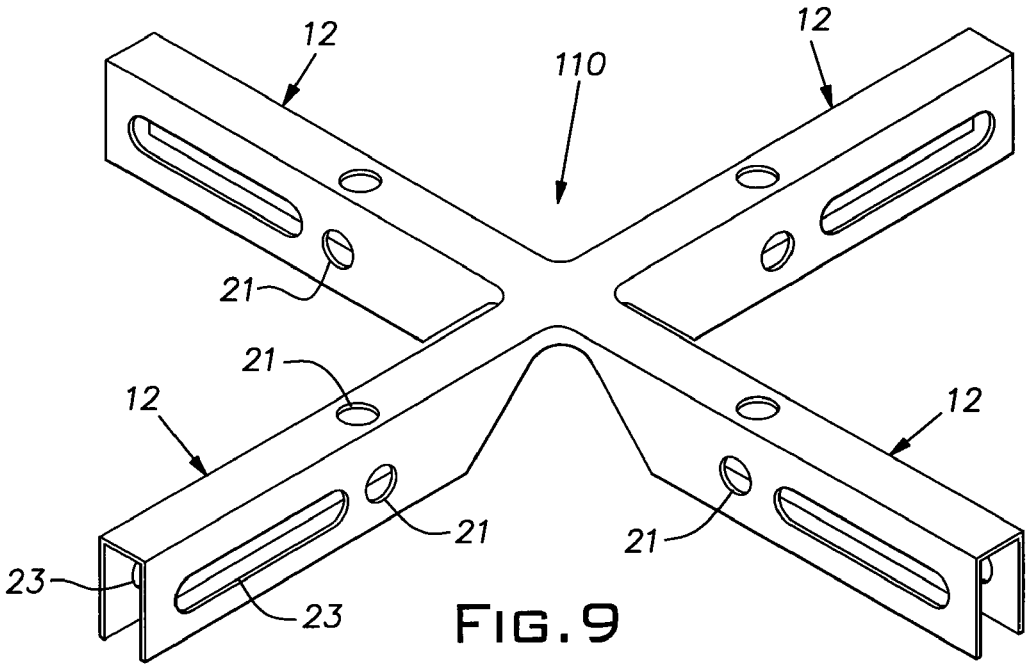
FIG. 9 is a perspective view of a second embodiment of the clip of the invention.

FIG. 9 illustrates a modified form of a clip 110. Parts of the clip 110 having the same structure and/or function as that of the earlier described clip 10 are identified with the same numerals. The modified clip 110 can be set over the tees at an intersection without regard to its orientation since each of the arms 12 has a slot 23 on both of its flanges 19. The clip 110 can be used in essentially the same manner as that described in connection with the clip 10. In addition, the modified clip 110 can be used in the situation where two control joints, perpendicular to one another intersect. In this case, two adjacent arms 12 and their respective slots 23, can be used to anchor the tee elements on the far side of the gaps (corresponding to the gaps 36, 41) to the intersecting tees on which the clip 110 is centered.

Either of the clips 10 or 110 can be used in non-seismic applications to reinforce an intersection of grid tees and assure proper alignment of the grid tees.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A clip for bridging a longitudinal gap between a pair of grid tee lengths, the clip having a cruciform shape in plan view formed by a set of four integral arms, one pair of the arms extending along a first line in opposite directions from a center of the clip, and another pair of arms extending along a line perpendicular to said first line in opposite directions from the center of the clip, said arms when oriented for installation having an inverted U-shape cross-section proportioned to be assembled vertically over a respective one of four intersecting lengths of grid tees having an inverted T-shape with a reinforcing hollow bulb at its upper edge, at least one of said arms having an elongated longitudinally extending fastener receiving slot and other of said arms having locations for receiving respective fasteners, said slot and receiving locations each being arranged to receive and allow a fastener and the respective arm to be anchored to the bulb of an associated tee, the length of the slot being at least as long as a desired gap between the gapped lengths of grid tees, the remaining arms being arranged to be locked relative to associated lengths of the intersecting tee lengths by fasteners positioned in said locations and received in the reinforcing bulbs of respective tee lengths, said slot being arranged to restrict its respective grid tee length to telescope within the associated arm a distance corresponding to the length of the slot in the event of an unusual force being applied longitudinally to said respective grid tee length, the slotted arm and the slot each being sufficiently long to overlie the bulb of a tee that is spaced from the end of an aligned tee that projects beyond the flanges of cross tees received in the clip so as to form a control joint.

2. A clip as set forth in claim 1, wherein said one arm has aligned longitudinal slots on opposite depending flanges.

3. A clip as set forth in claim 1, wherein said fastener locations are preformed holes.

4. A clip as set forth in claim 1, wherein said arms include a pair of opposite elements each of which include a longitudinal slot for receiving a fastener to be anchored in a respective grid tee bulb.

5. A clip as set forth in claim 4, wherein said arms include fastener receiving locations in an upper web and in depending flanges.

6. A clip as set forth in claim 1, comprising a single piece of stamped sheet metal.

7. A clip as set forth in claim 1, wherein said arms include an opposed symmetrical pair, each having a pair of opposed slots and a separate fastener locating position.

8. A clip as set forth in claim 1, wherein each arm includes an elongated longitudinally extending slot and a separate fastener locating position.

9. A clip for stabilizing lengths of grid tees of a suspended ceiling wherein at least the grid tee lengths along one run include a control joint gap at or near at the intersection on which said clip is installed, said clip having a cruciform shape in plan view and four integral arms each of which has an inverted U-shape configuration, at least one of said arms being sufficiently long and having an elongated longitudinally extending slot sufficiently long for receiving a screw anchored in a reinforcing bulb area of a grid tee length on the far side of a control joint between a proximate grid tee end projecting beyond the flanges of cross tees assembled in the clip and the proximate end of the far side grid tee length, whereby a screw can serve to anchor the grid tee length and the clip together while allowing limited relative motion therebetween.

10. A clip as set forth in claim 9, wherein said longitudinal slot is at least about ¾" or similar metric dimension in length.

11. A clip as set forth in claim 10, wherein said slot is closed at each end.

* * * * *